US005588585A

United States Patent [19]

McClure

[11] Patent Number: 5,588,585

[45] Date of Patent: Dec. 31, 1996

[54] AUTOMATIC SET-UP CARTON WITH CORNER POSTS

[75] Inventor: Jack A. McClure, Garden City, Kans.

[73] Assignee: Inland Container Corporation, Indianapolis, Ind.

[21] Appl. No.: 616,593

[22] Filed: Mar. 15, 1996

[51] Int. Cl.[6] ..... B65D 21/032; B65D 21/036

[52] U.S. Cl. ..... 229/191; 229/149; 229/918

[58] Field of Search ..... 229/149, 150, 229/154, 191, 918

[56] References Cited

U.S. PATENT DOCUMENTS

| | | | |
|---|---|---|---|
| 1,207,899 | 12/1916 | Greve | 229/191 |
| 3,034,698 | 5/1962 | Forrer | 229/191 |
| 4,129,247 | 12/1978 | McCall | 229/191 |
| 4,770,339 | 9/1988 | Weimer | 229/918 |
| 4,799,620 | 1/1989 | ViLella | 229/918 |
| 5,294,044 | 3/1994 | Clark | 229/191 |
| 5,330,094 | 7/1994 | Mertz | 229/191 |
| 5,372,299 | 12/1994 | Edgerton, Jr. et al. | 229/191 |
| 5,458,283 | 10/1995 | Southwell et al. | 229/191 |

*Primary Examiner*—Gary E. Elkins

*Attorney, Agent, or Firm*—Fitch, Even, Tabin & Flannery

[57] ABSTRACT

A carton blank from a one-piece blank includes a floor and sidewalls, with corner posts at the corners of the carton. The corner posts include end panels located beside adjacent sidewalls and a plurality of intermediate panels folded to form a Z-shape cross-section.

15 Claims, 10 Drawing Sheets

AUTOMATIC SET-UP CARTON WITH CORNER POSTS

BACKGROUND OF THE INVENTION

1. Field of the Invention

The present invention pertains to containers made of paper products, such as paperboard, and in particular to such containers formed from an integral blank.

2. Description of the Related Art

Containers for shipping relatively heavy, dense articles such as beef products and other articles are often stacked one on top of another as they are shipped from place to place, and subsequently stored. Oftentimes, when stacking cartons containing relatively dense, heavy articles, box-to-box telescoping would be noticed. In order to prevent undesired telescoping, corner posts may be included in the carton construction. The corner posts may be formed separately and later added to a carton receptacle. A corner post may be formed of the same material as the paperboard container, or may be formed of a different material, such as styrofoam, for example. Alternatively, the reinforcing posts may be provided at the corner of a box, the posts being formed with the box from an integral blank. An example of this type of construction is given in commonly owned U.S. Pat. No. 5,000,377. It is generally preferred that, if at all possible, a corrugated cardboard container be fabricated from a unitary blank, and that the blank have a design which is as efficient as possible, reducing wasted paperboard material to a minimum.

Containers made of paperboard material continue to offer significant cost savings in many important commercial applications. Frequently, end users such as those at a factory location, refer to erect cartons from time to time, as required. Thus, consideration must be given not only to the labor required to form a carton blank and erect a "knocked-down" carton for shipment to an end user, but also the labor required by the end user to set up the knocked-down blank must also be taken into account. Over the years, automated machinery has been developed to aid these operations. Capital investment for this machinery has already been made, and personnel are acquainted with the efficient operation of this equipment. It is desirable, if at all possible, to provide carton products which are adapted for use with such conventional machinery.

SUMMARY OF THE INVENTION

It is an object of the present invention to provide a carton blank and cartons formed from the blank which are adapted for use with conventional carton-forming machinery.

Another object of the present invention is to provide a carton having corner post reinforcements, integrally formed with the carton blank, and which are automatically erected as a carton is set-up at an end user's location.

A further object of the present invention is to provide cartons having corner posts of the above-described type, which exhibit improved stacking strength.

These and other objects according to principles of the present invention are provided in a carton formed from a one-piece blank, comprising:

a floor;

a pair of opposed first side walls hingedly joined to the floor along respective fold lines;

a pair of opposed second side walls hingedly joined to the floor along respective fold lines, said first side walls and said second side walls each having opposed side edges located at outside corners of the carton;

and at least one corner post extending from a side edge of one of said second side walls adjacent a side edge of one of said first side walls and, said corner post comprising a serial succession of post panels joined end-to-end by fold lines, the post panels folded with a double-reentrant fold to generally form a Z-shape cross-section.

Other objects of the present invention are provided in a carton formed from a one-piece blank, comprising:

a floor;

a pair of opposed first side walls hingedly joined to the floor along respective fold lines;

a pair of opposed second side walls hingedly joined to the floor along respective fold lines;

said first side walls and said second side walls each having opposed side edges located at outside corners of the carton; and at least one corner post extending from a side edge of one of said second side walls adjacent a side edge of one of said first side walls and, said corner post comprising a first post panel extending along said one of said first sidewalls and hingedly joined a second post panel, a third post panel hingedly joined to said second post panel, and a fourth post panel having first and second ends and hingedly joined at a first end to said third post panel and coupled at a second end to said one of said second side walls, said third post panel positioned between said second and said fourth post panels with said second and said fourth post panels partly overlying one another and said second, said third and said fourth post panels forming a Z-shape cross-section.

DETAILED DESCRIPTION OF THE PREFERRED EMBODIMENTS

Figure 1:
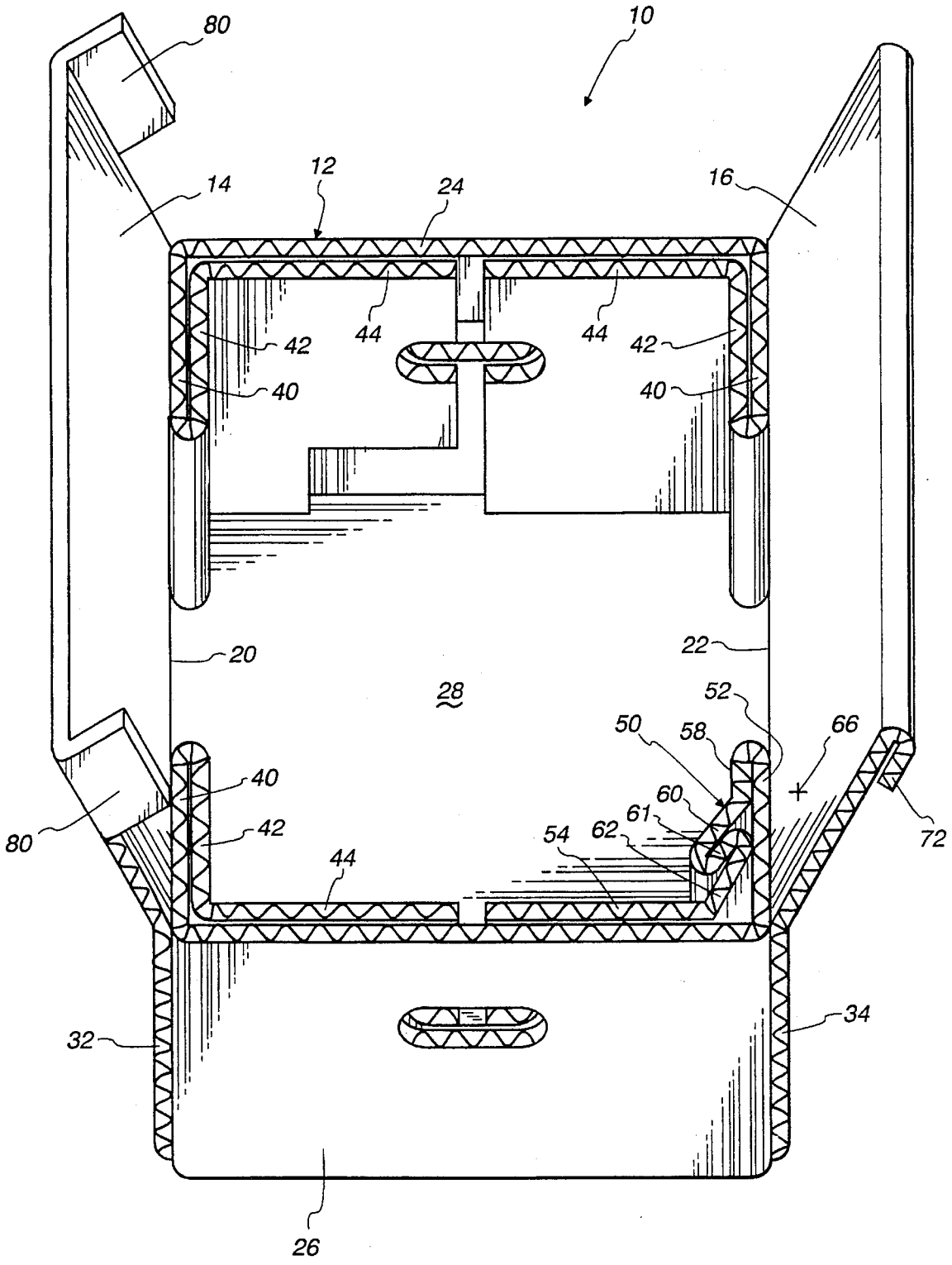
FIG. 1 is a perspective view of a carton according to principles of the present invention.

Turning now to FIGS. 1–8, a first embodiment of a carton illustrating principles according to the present invention is generally indicated at 10. Carton 10 preferably comprises a lidded or closed container having an open top receptacle portion generally indicated at 12 and lid members 14, 16. The receptacle portion 12 includes a pair of opposed first sidewalls 20, 22 and a pair of opposed second sidewalls 24, 26. The sidewalls 20–26 are hingedly joined to a floor member 28 along respective fold lines. In the preferred embodiment, the floor 28, the sidewalls and lid members preferably have variously proportioned rectangular shapes.

The corners of the receptacle are preferably formed with the use of adhesives. For example, the free ends 32, 34 of the sidewalls 20, 22 are arranged to overlay internal panel members and are secured to the various internal panel members with a suitable adhesive.

For example, the carton 10 illustrated in the drawings has conventional corner post constructions in three of the four corners of the receptacle. These conventional corner post constructions include three panels 40, 42 and 44 disposed against, or immediately adjacently the sidewalls of the carton receptacle. The remaining corner (i.e., the bottom right corner in FIG. 1) of the carton includes a corner post generally indicated at 50. The corner posts include first and second post panels 54, 62, respectively, and third, fourth and fifth post panels 61, 60 and 58, with the second, third and fourth post panels folded with a double-reentrant fold to form a Z-shape cross-section.

As can be seen by comparison with the conventional corner posts, corner post 50 forms triangular cavities with the adjacent sidewall and endwall and provides a larger area of support at its upper and lower ends. The corner post 50 has a stable, relatively dense cross-section to provide enhanced strength against compression (resulting in telescoping of stacked boxes) and, in addition, supports greater weight than the conventional corner posts. Further, the Z-shape double-reentrant fold provides added support for lid member 16 at a reference point 66 spaced from the free edges and fold line of the lid member. This has been found to provide an enhanced support of the lid member against a buckling deformation, as when a lead is concentrated at a mid-portion of the lid member.

Figure 2:
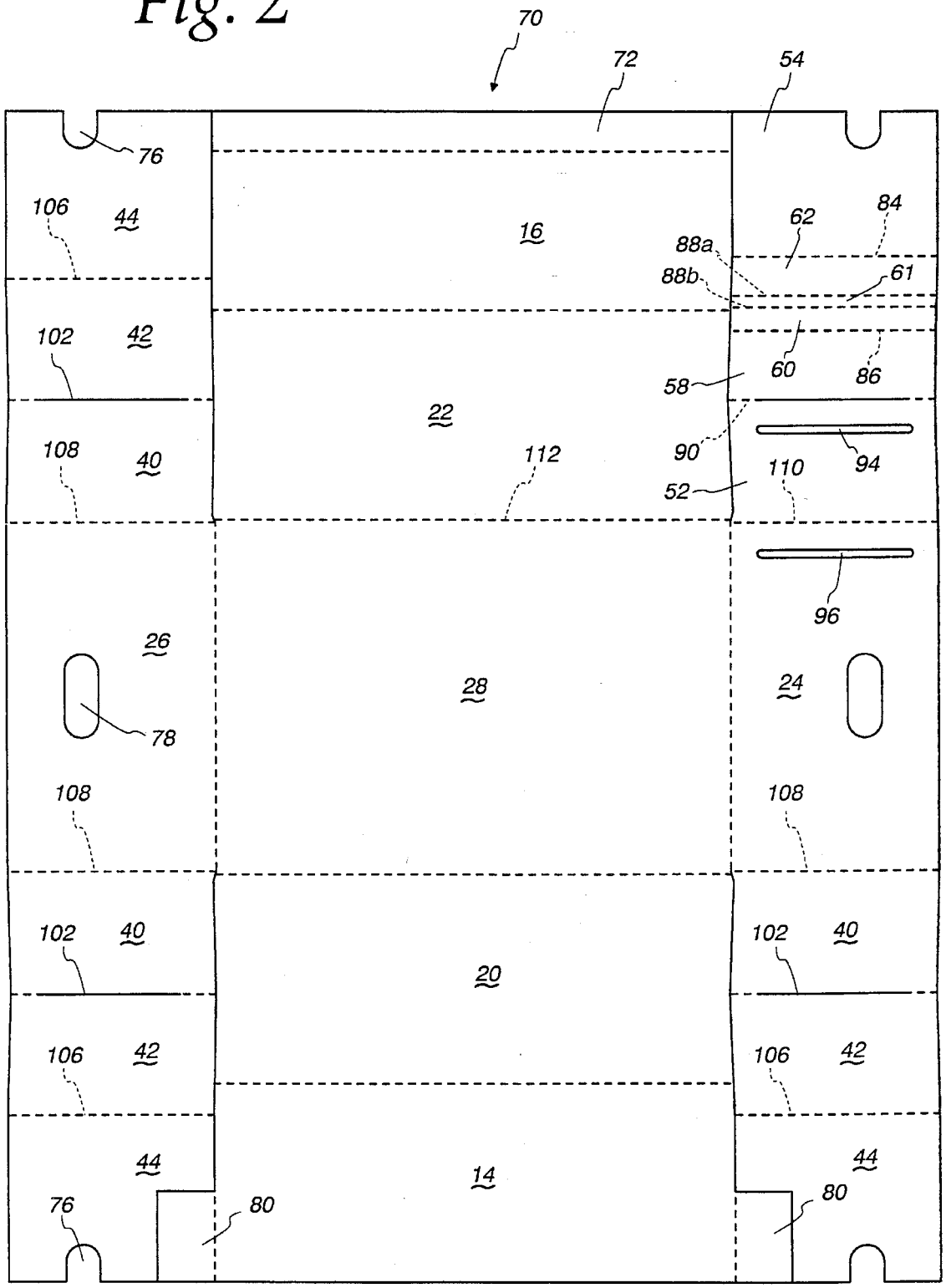
FIG. 2 is a top plan view of a blank from which the carton is formed.

The container 10 is preferably formed from an integral paperboard blank. Referring now to FIG. 2, the blank is generally indicated at 70 and, as can be seen in FIG. 2, comprises three rows of carton portions, including a pair of outside rows including hand holds, and an intermediate row placed therebetween. The three rows of carton blank 70 each comprise a serial succession of carton portions, joined end-to-end by fold lines. The intermediate row comprises a serial succession of the lid member 16, which preferably includes an optional dust-sealing flap 72, a first sidewall 22, floor 28, another first sidewall 20 and lid member 14.

The outside row of carton portions appearing to the left of FIG. 2 includes a serial succession of conventional corner post panels 44, 42 and 40, a second sidewall 26 and panels 40, 42 and 44 of a second conventional corner post. The conventional corner post panels 44 have partial hand holes 76 struck therefrom, while the second sidewall 26 has a completed hand hole 78 struck therefrom. In addition, a sealing tab 80 is struck from the lowermost panel 44. The sealing tab 80 (sometimes referred to as a "glue tab" in the industry) is adhesively secured to the second sidewall 26 to maintain the lid members in a fully closed position.

The remaining outside row of carton portions includes a series of post panels forming the corner post 50. Included is the serial succession of first, second, third, fourth and fifth post panels 54, 62, 61, 60 and 58, respectively. The first post panel 54 is joined to second post panel 62 by a fold line 84, preferably formed by scoring the carton blank 70. The fourth and fifth post panels 60, 58 are also hingedly joined together by a similar fold line 86. The fourth and second post panels 60, 62 are coupled together by the third post panel 61, which lies between fold lines 88*a*, 88*b*. Fifth post panel 58 and a connecting panel 52 are joined together by a fold line 90 which includes a substantial cut portion in addition to scored end portions. If desired, panel 52 can be omitted, and the corner post panel can be joined to sidewall 22 although this is not preferred since ease of assembly will be compromised.

Figure 3:
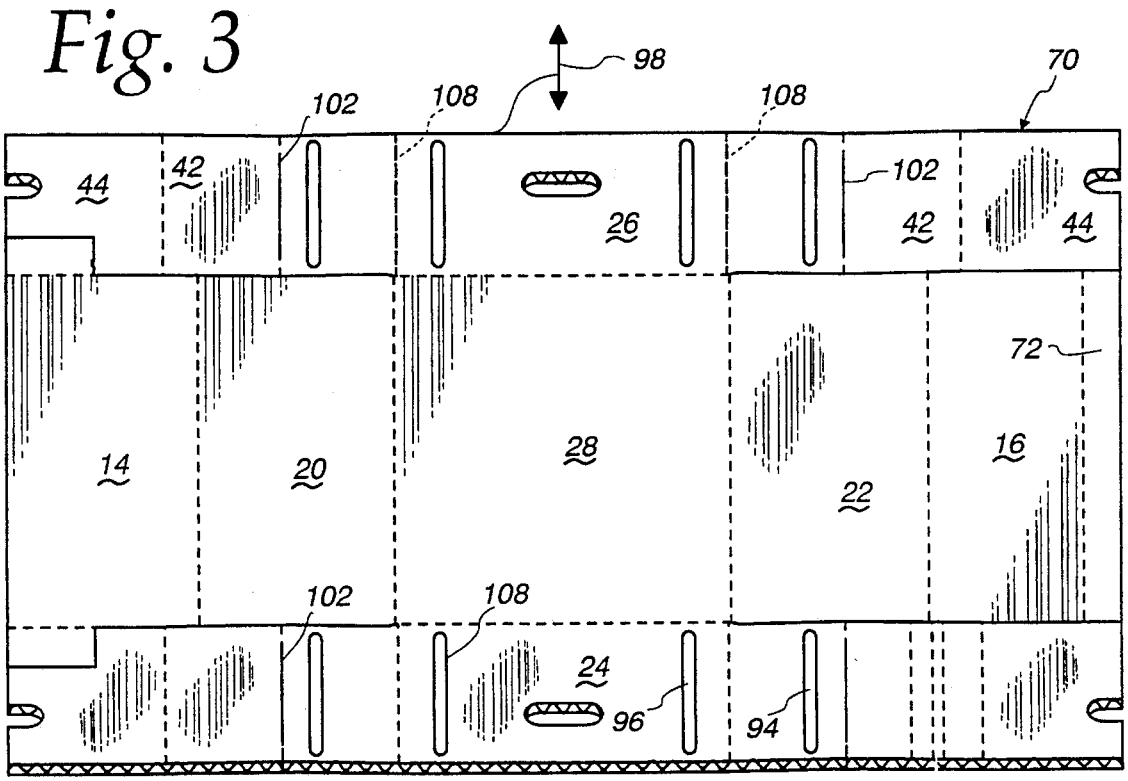
FIGS. 3–8 show successive stages in forming the carton blank.

As can be seen in the drawing, the bottom right hand portion of FIG. 2 is a mirror image of the bottom left hand portion of the Figure, also, the second sidewall 24 is a mirror image of the sidewall 26. As will be seen shortly herein, corner post 50 is automatically set up when carton 10 is erected by folding blank 70. As can be seen in the bottom right hand corner of FIG. 1, corner post 50 requires considerable distortion of the paperboard material. As can be seen in FIG. 3, it is preferred that adhesive strips 94, 96 be employed to assist in controlling bending of the intermediate corner post panels. Referring briefly to FIGS. 2 and 3, adhesive is preferably applied to carton blank 70 by passing the carton blank through a conventional adhesive applicator machine, in the direction of arrow 98. Adhesive is also conveniently applied to the upper end of the carton blank shown in FIG. 3 along the same "glue lines." It is also generally preferred that the application of adhesive be applied in a mirror image to the left hand side of the carton blank.

Figure 4:
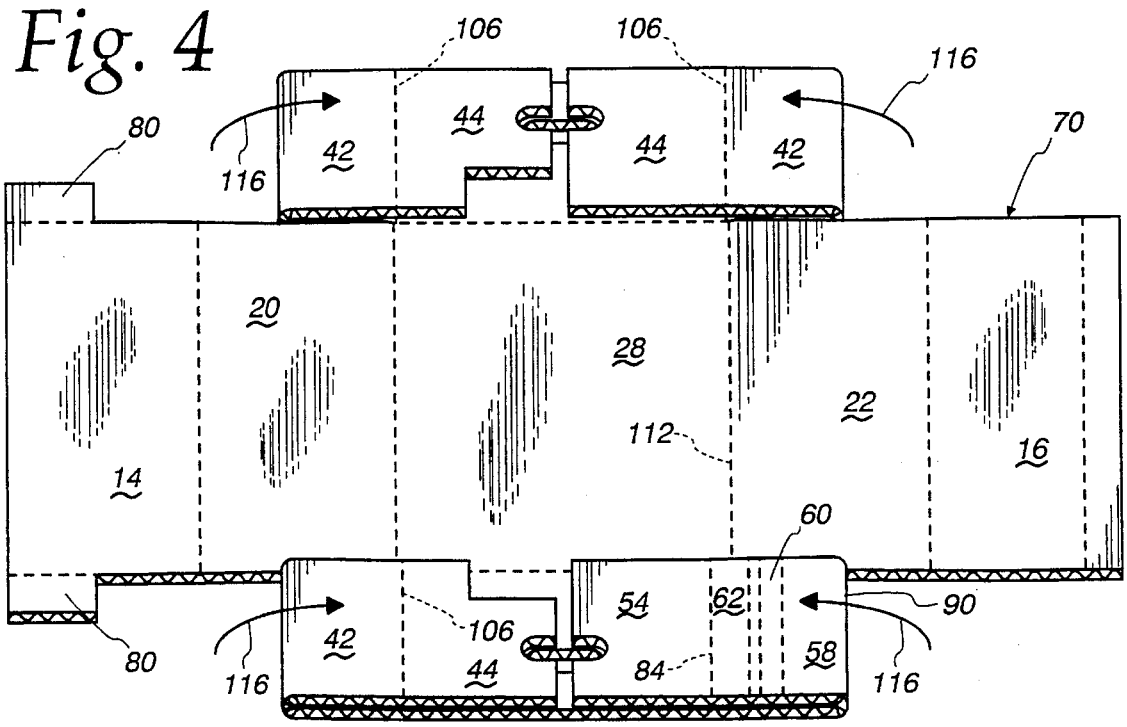

Referring now to FIG. 4, the carton blank 70 is folded along the fold line 90 discussed above, and also along fold lines 102. In the folded condition illustrated in FIG. 4, the fold lines 106 joining the panels 42, 44 are aligned with the fold lines 108 joining the sidewalls 26 or 24 to the panels 40. However, as can be seen in the bottom right corner of FIG. 4, the fold line 84 is not aligned with the fold line 110 joining end wall 24 to panel 52. As can be seen in FIG. 2, fold line 110 is generally aligned with the fold line 112 joining floor 28 to sidewall 22, the fold line 112 being visible in FIG. 4. Preferably the score lines 84, 88*a* and 86 are heavily scored (e.g., multiple passes of a scoring wheel) to increasing the tendency of those scores to fold in the desired direction.

Figure 5:
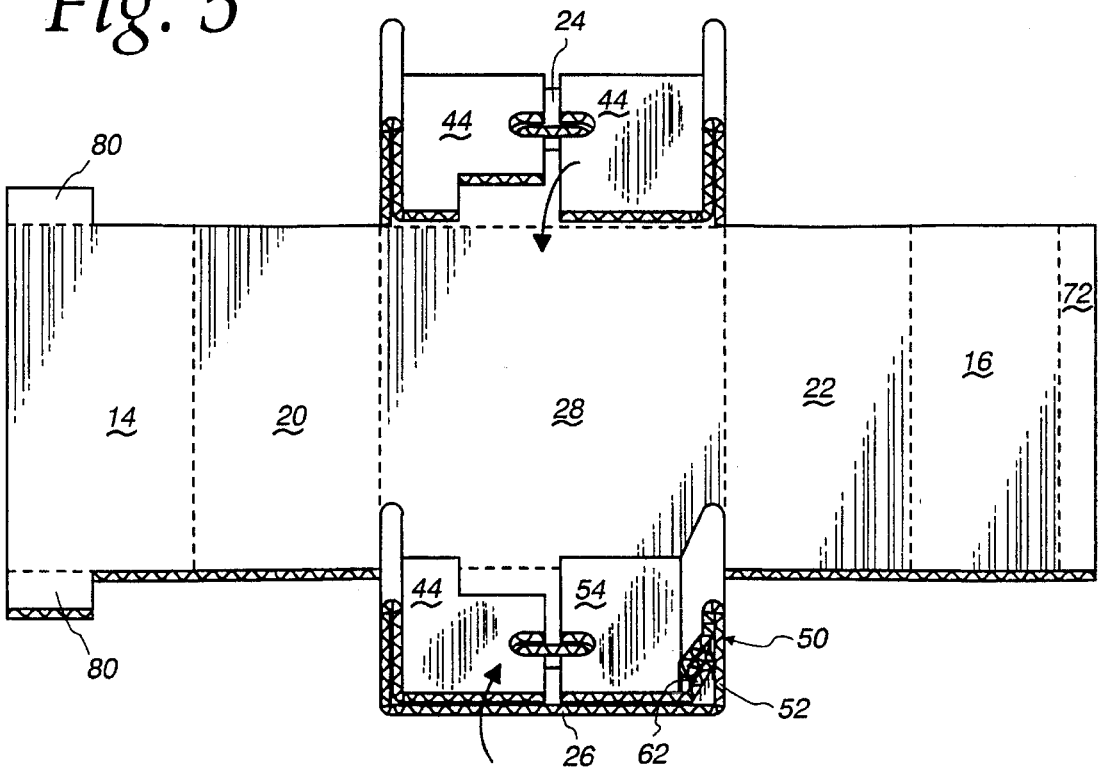

The carton blank is then folded in the direction of arrows 116 to form the corner post, as shown in FIG. 5. The corner post 50 is automatically set up by applying a bending force in the direction of arrows 116 (as shown in FIG. 4) without requiring additional manipulation of the carton blank. Referring to FIG. 4, as the bottom right hand corner of the carton blank is bent in the direction of arrow 116, intermediate panel 62 "dives under" the panel 60, with the panel 61, in effect, being tucked between the panels 60, 62.

Figure 6:
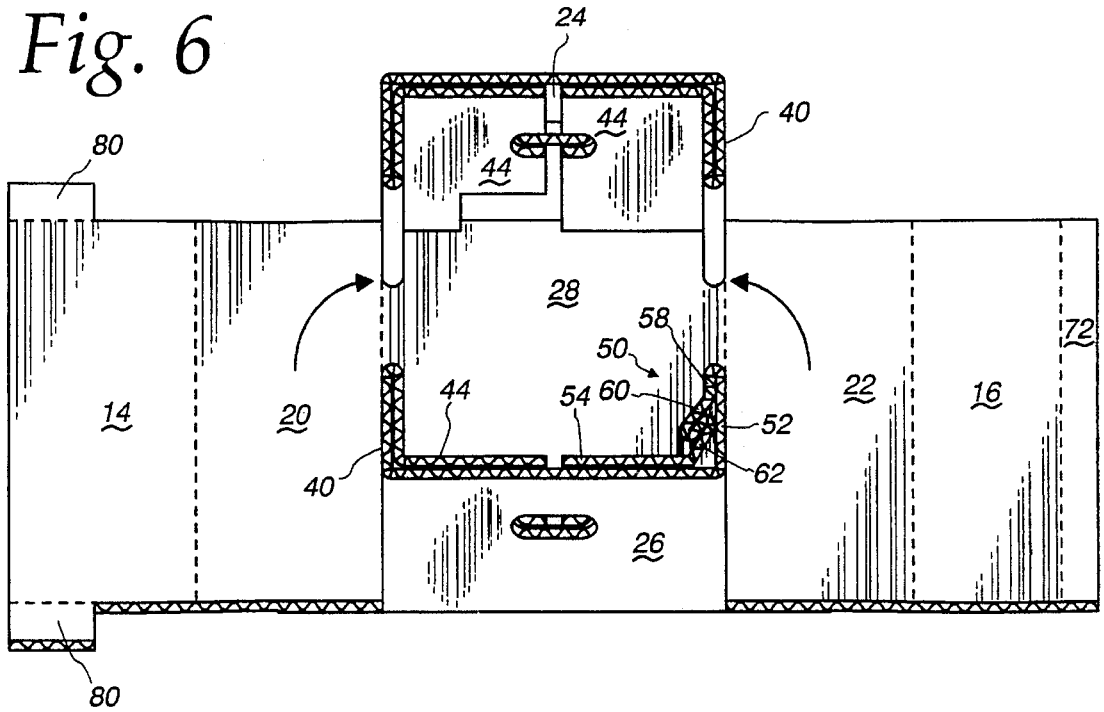
Figure 7:
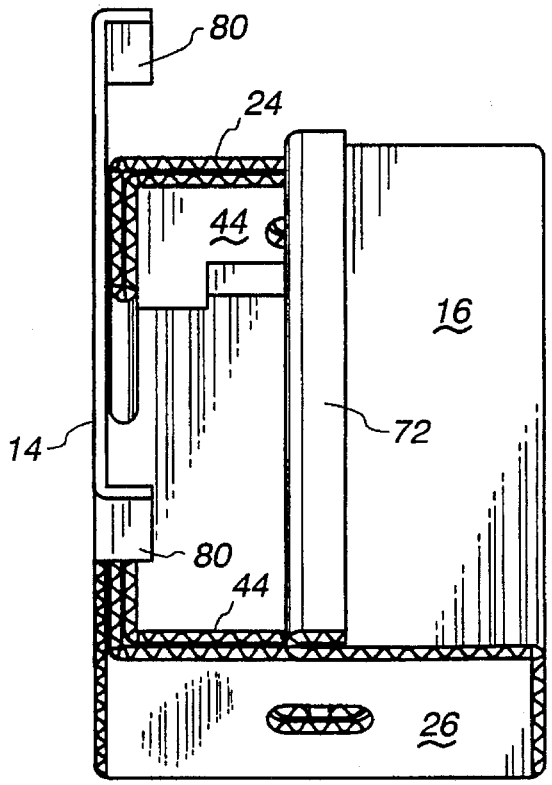
Figure 8:
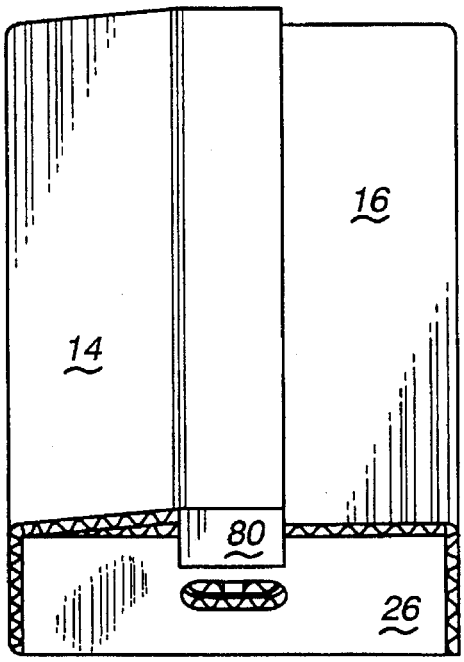

Referring now to FIGS. 5 and 6, the sidewalls 24, 26 are raised to a generally vertical position, bringing the lower ends of the corner posts into contact with the floor 28. As shown in FIGS. 6 and 7, the sidewalls 20, 22 are then raised to an upright position, preferably being adhesively secured to the corner post panels they contact. For example, sidewall 22 is adhesively joined to connecting panel 52 and to panel 40 of the conventional corner post remaining on the right hand side of the carton. In a similar manner, the sidewall 20 is raised to a vertical position and adhesively secured to the exposed surfaces of corner post panels 40, to form the structure illustrated in FIG. 7. The lid panel 16 is then lowered into position, as illustrated in FIG. 7, with dust flap 72 facing upwardly. The lid panel 14 is then closed, as illustrated in FIG. 8, and securement tabs 80 are then adhesively secured to the sidewalls of the carton, to lock the lids in a closed position.

Although the carton 10 is illustrated with only one corner post 50, it can be seen from the above that the corner post 50 could be located at all four corners of the carton. Further, from examining FIG. 2, for example, it can be seen that no additional material is required, resulting in savings in the cost of the carton blank. If maximum stacking strength and reduction in telescoping compression of stacked cartons is desired, then it is preferred that all four corner posts of the carton comprise corner post 50. Further, it will now be appreciated, as pointed out above, that the increased support area provided by corner post 50 is provided without requiring additional material that would otherwise be used for conventional corner posts. Further, the corner post 50 can be set up "automatically," requiring only the simple folding steps customary for conventional carton construction. The same advantages will be seen in the following embodiment of the present invention.

Figure 9:
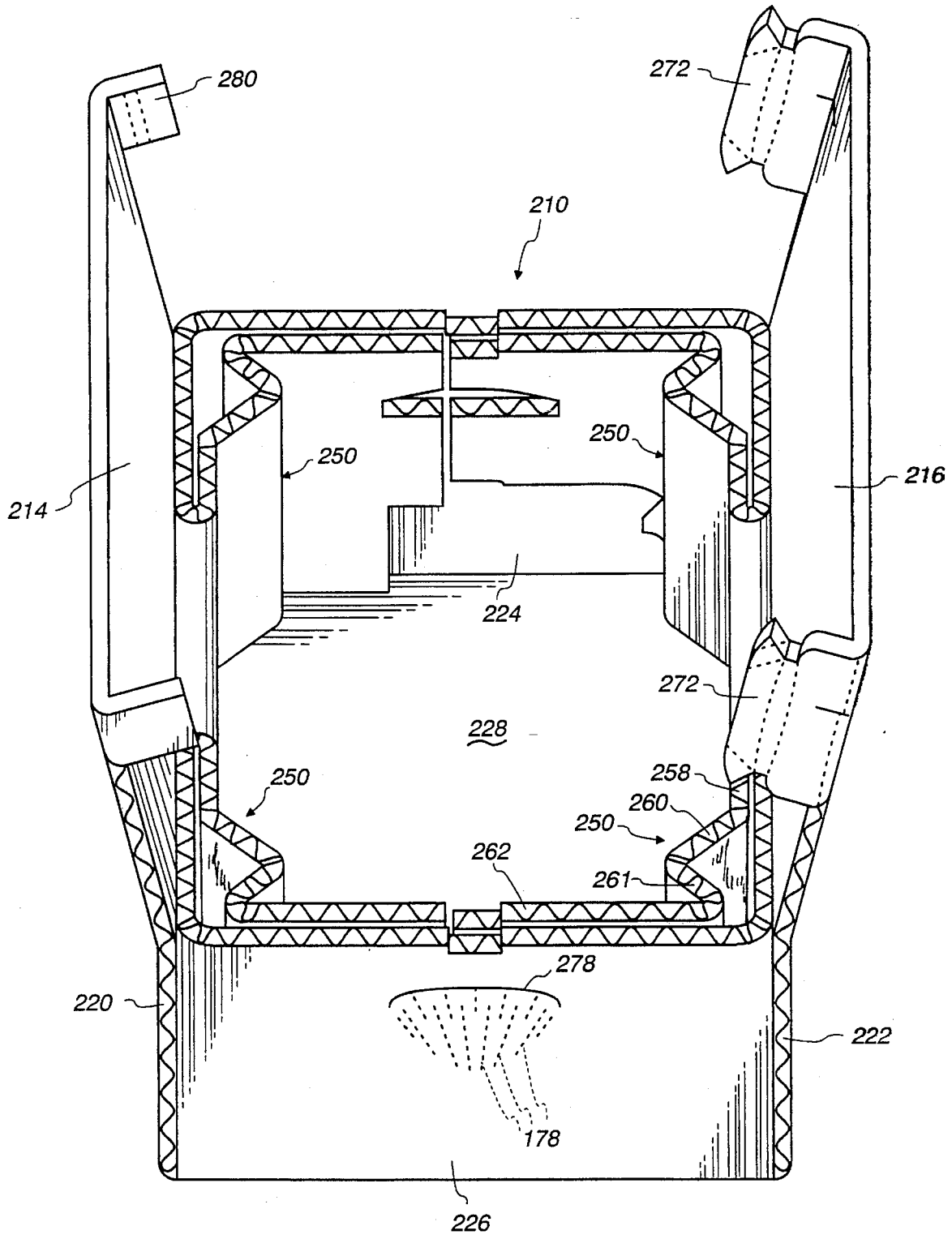
FIG. 9 is a perspective view of an alternative carton illustrating principles of the present invention.

Turning now to FIGS. 9–16, another example of a carton illustrating principles of the present invention is generally indicated at 210. Carton 210 includes a floor 228, a pair of first opposed sidewalls 220, 222 and a pair of second opposed sidewalls 224, 226. Carton 210 includes four corner posts 250 as well as lid members 214, 216. Fastener tabs 280 are carried on lid member 214, while locking ears 272 are carried on lid member 216. An arcuate cut 278 is formed in sidewall 226, as can be seen in FIG. 9. Score lines 178 are formed in sidewall 226 to form a collapsible region allowing the user to grasp the carton by the edge of cut 278, thus providing the combined functional equivalent of a hand hole and dust-flap. In the first embodiment, carton 210 preferably has floor, sidewalls and lid members comprising variously proportioned rectangular shapes.

Figure 10:
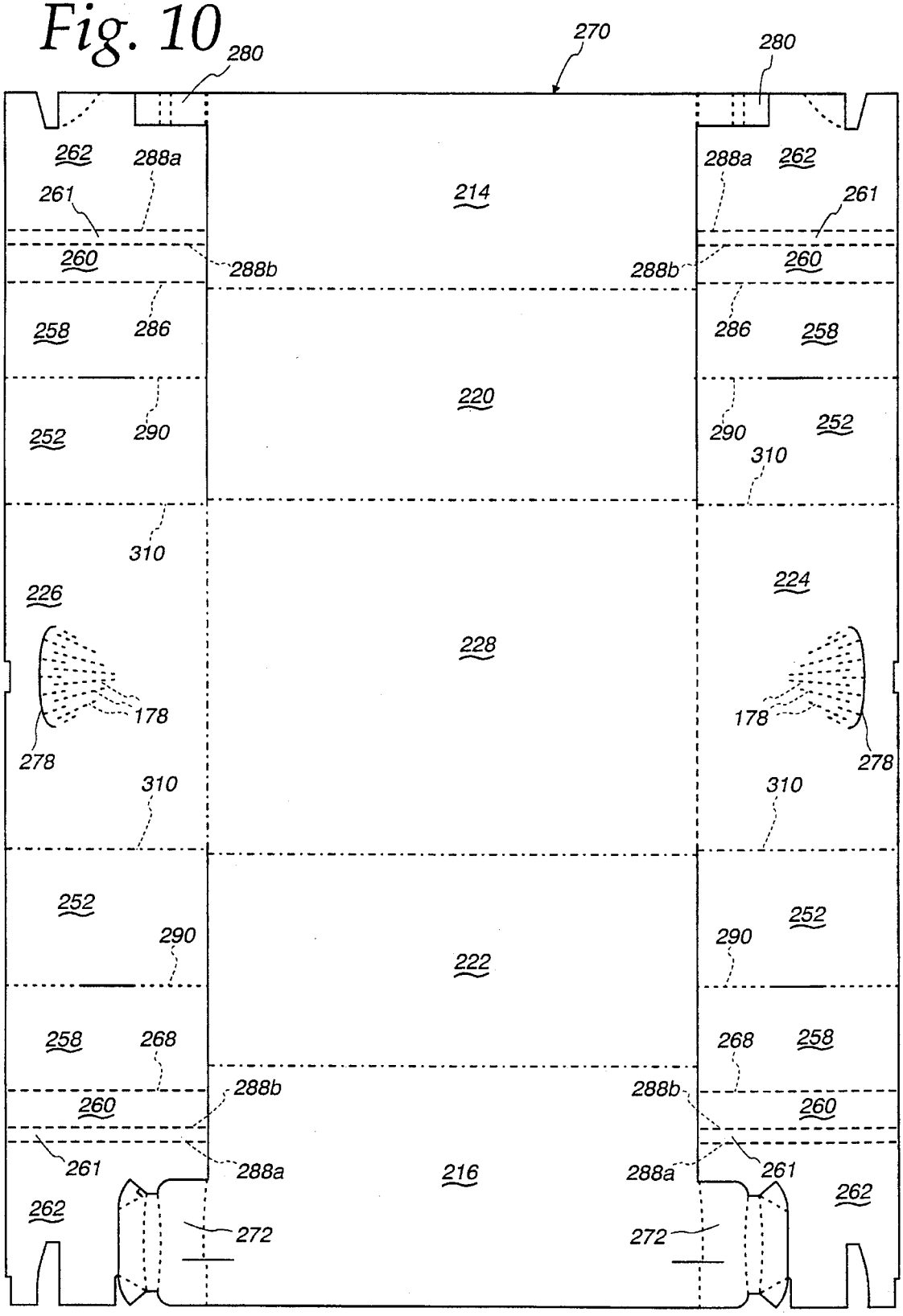
FIG. 10 is a plan view of a carton blank from which the carton is formed.

As with the first carton 10, carton 210 is preferably formed of an integral paperboard blank. Turning now to FIG. 10, blank 270 is seen to comprise three rows of carton portions, including a pair of outside rows and an intermediate row. Each of the three rows comprises a serial succession of carton portions joined together along fold lines. The intermediate row comprises the serial succession of lid member 214, sidewall 220, floor 228, sidewall 222 and lid member 216. The carton blank 270 is symmetric about a vertical centerline extending to the middle of FIG. 10. As such, the outside rows are mirror images of one another. The right hand outside row comprises the serial succession of a second end panel 262, panel 261, intermediate panels 260, 258, a first end panel 252 and the sidewall 224. As mentioned, the corner posts are preferably of similar construction, and accordingly, the right hand outside row continues (below sidewall 224) connecting panel 252, and post panels 258, 260, 261 and 262.

The panel 262 is joined to panel 261 which lies between a pair of fold lines **288*a* and 288*b*. The panels 258, 260 are joined together along fold line 286, and the panel 258 is joined to panel 252 by a fold line 290 which includes a central cut portion. The panel 252 is joined to sidewall 224 by a fold line 310. The panel 252 can be omitted, and post panel 258 could be joined directly to sidewall 22**, but this is not preferred, since ease of construction and automatic set-up advantages will be compromised.

Figure 11:
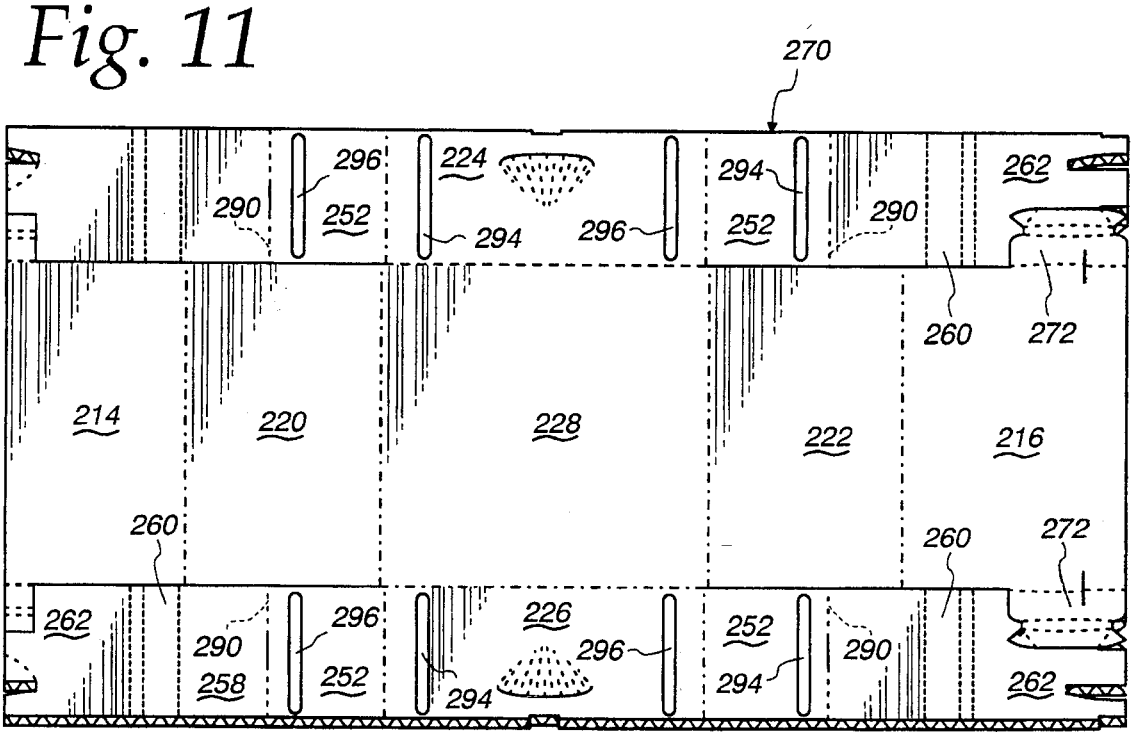
FIGS. 11–16 show successive stages of erecting the carton from the carton blank.

As in the preceding embodiment, it is generally preferred that the corner post 250 be capable of automatic set-up, when erecting the carton using simple conventional folding operations on carton blank 270. Accordingly, it is generally preferred that adhesive be applied to help secure the corner post panels, to aid in withstanding the forces generated in the carton blank when the corner post panels are folded up to assume the configurations generally shown in FIG. 9. Accordingly, adhesive stripes 294, 296 are applied to the carton blank 270, as illustrated in FIG. 11. The carton blank is then folded along fold lines 290 in the manner illustrated in FIG. 12, as an initial step in preparing the corner post constructions. Preferably, the score lines 286, **288*a*** are re-scored or otherwise more heavily scored to remove their resistance to folding a direction toward the outside face of the carton.

Figure 12:
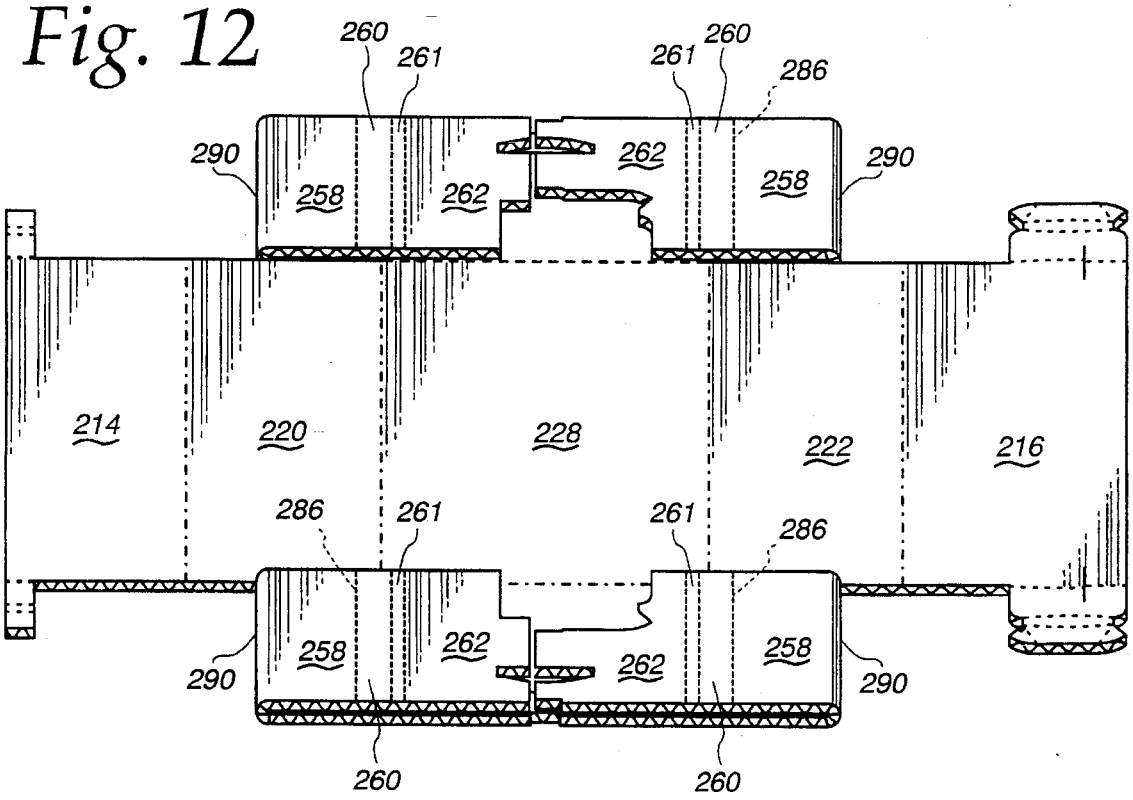
Figure 13:
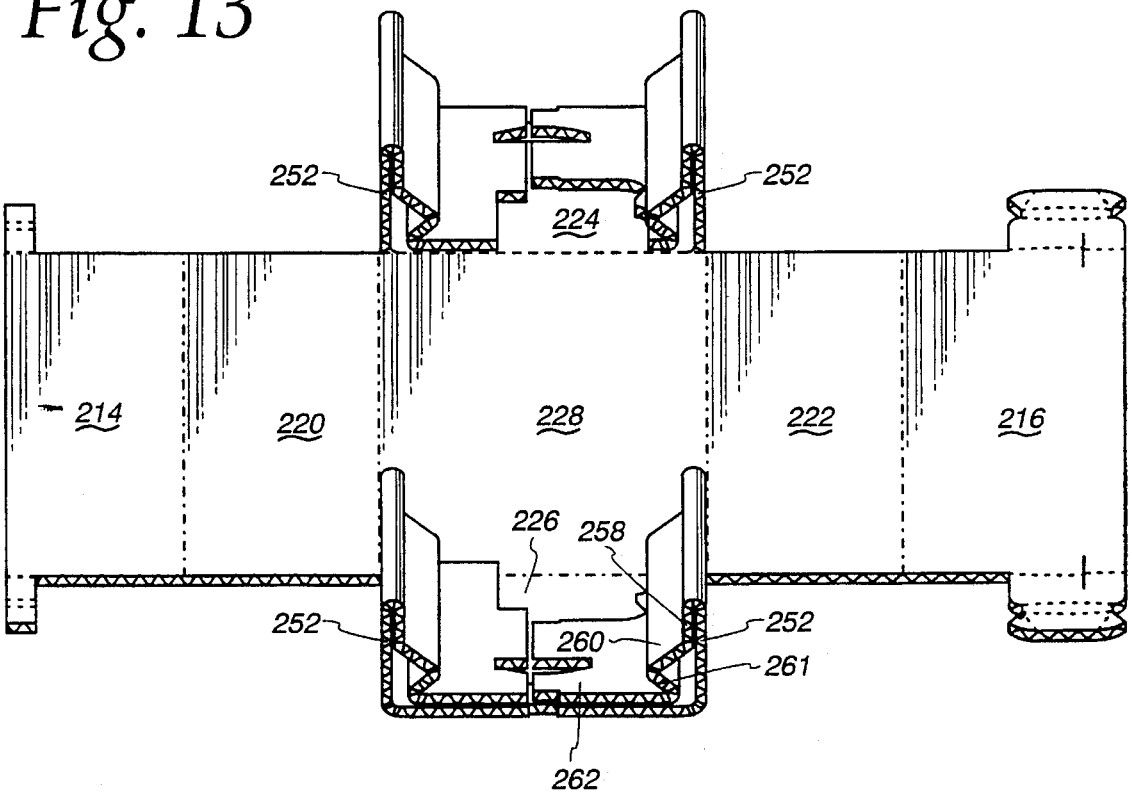

Referring now to FIGS. 12 and 13, with upward bending pressure applied to panels 258, connecting panels 252 are raised to a substantially vertical position as indicated in FIG. 13. This causes the post panels to automatically fold up in the manner desired to form the corner posts 250. The adhesive strips help to concentrate forces at the fold lines, causing the paperboard blank to simultaneously bend in different directions and at multiple fold lines.

Figure 14:
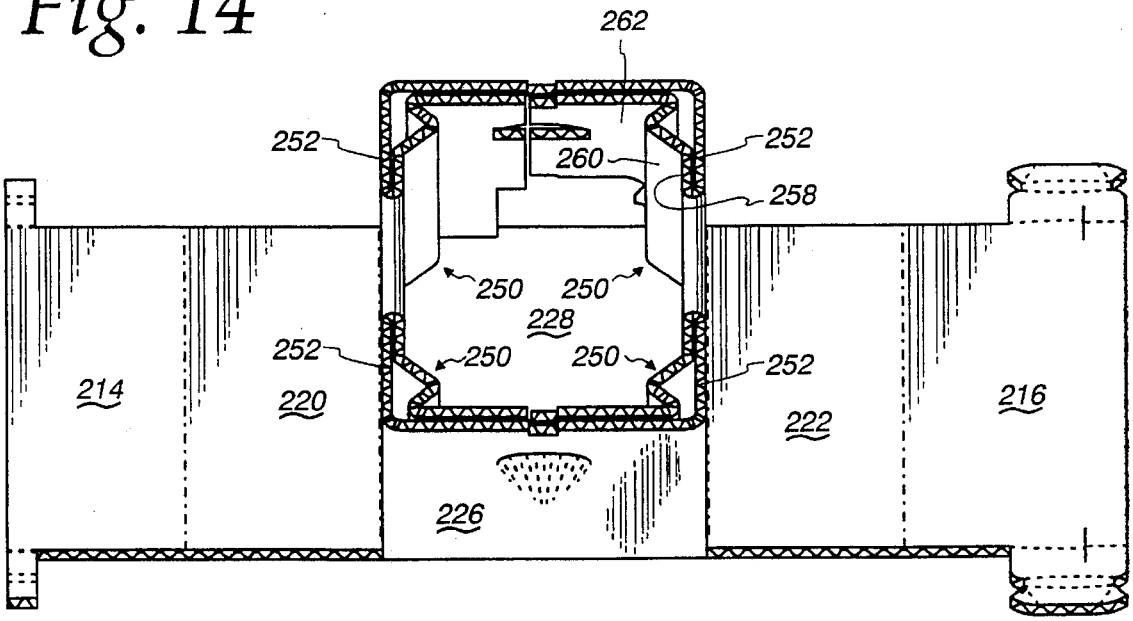
Figure 15:
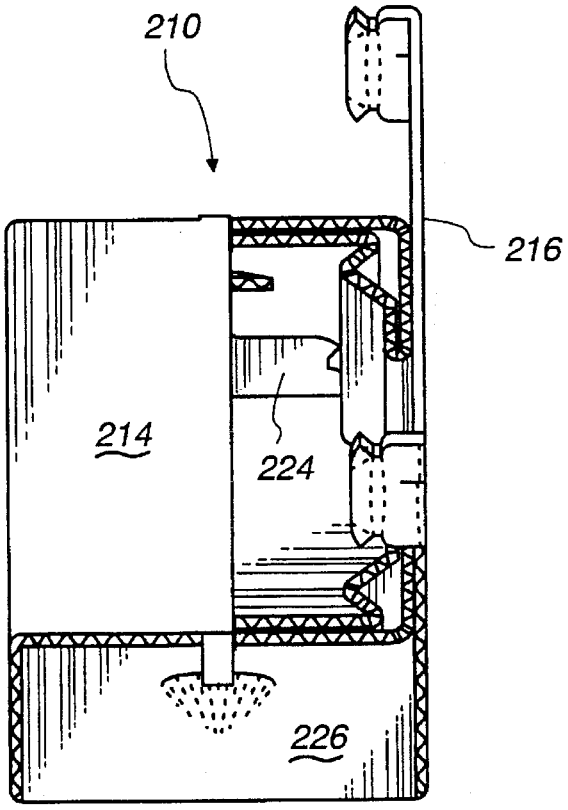

With reference to FIG. 14, the sidewalls 224, 226 are then raised to a substantially vertical position, bringing the bottom ends of the corner posts 250 into engagement with the floor 228. Referring additionally to FIG. 15, the sidewalls 222, 220 are then raised to the vertical positions illustrated in FIG. 15, contacting the corner post panel 252. It is generally preferred that the sidewalls 222, 220 be secured with adhesive to the corner post 252.

Figure 16:
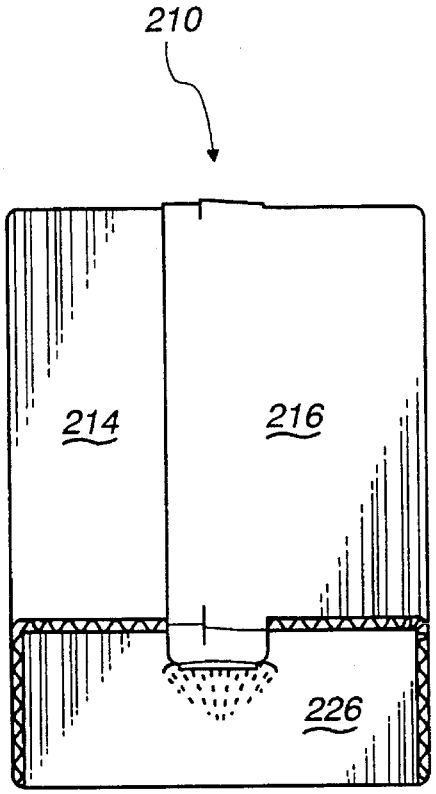

Referring to FIGS. 15 and 16, the lid members 214, 216 are then lowered in the manner indicated, and secured to the sidewalls 224, 226 to close the carton interior.

As with the corner post 50, the corner posts 250 include end panels and a plurality of intermediate panels therebetween and in serial succession therewith. The corner post panels are folded to form a Z-shape cross-section.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A carton formed from a one-piece blank, comprising:

a floor;

a pair of opposed first side walls hingedly joined to the floor along respective fold lines;

a pair of opposed second side walls hingedly joined to the floor along respective fold lines, said first side walls and said second side walls each having opposed side edges located at outside corners of the carton;

and at least one corner post extending from a side edge of one of said second side walls adjacent a side edge of one of said first side walls and, said corner post comprising a serial succession of post panels joined end-to-end by fold lines, the post panels folded with a double-reentrant fold to generally form a Z-shape cross-section.

2. The carton of claim 1 wherein said post panels are folded so as to cooperate with said one second side wall and said one first side wall to form at least one generally triangular pocket.

3. The carton of claim 1 wherein at least two of said post panels are folded to at least partly engage one another.

4. The carton of claim 1 wherein at least two of said post panels are folded so as to avoid engaging one another.

5. The carton of claim 1 wherein at least one of said first post panels overlies a first sidewall.

6. The carton of claim 1 further comprising a pair of lid members hingedly joined to respective ones of the second side walls.

7. The carton of claim 1 wherein said first and said second post panels and said first and said second sidewalls are of generally equal height.

8. A carton formed from a one-piece blank, comprising:

a floor;

a pair of opposed first side walls hingedly joined to the floor along respective fold lines;

a pair of opposed second side walls hingedly joined to the floor along respective fold lines;

said first side walls and said second side walls each having opposed side edges located at outside corners of the carton; and at least one corner post extending from a side edge of one of said second side walls adjacent a side edge of one of said first side walls and, said corner post comprising a first post panel extending along said one of said first sidewalls and hingedly joined a second post panel, a third post panel hingedly joined to said second post panel, and a fourth post panel having first and second ends and hingedly joined at a first end to said third post panel and coupled at a second end to said one of said second side walls, said third post panel positioned between said second and said fourth post panels with said second and said fourth post panels partly overlying one another and said second, said third and said fourth post panels forming a Z-shape cross-section.

9. The carton of claim 8 wherein said first and said second post panels and said first and said second sidewalls are of generally equal height.

10. The carton of claim 8 wherein said first post panel of said corner post overlies a first sidewall and said fifth post panel of said corner post overlies said one of said second side walls.

11. The carton of claim 8 wherein said corner post further comprises a fifth post panel between said fourth post panel and said one of said second side walls.

12. A carton formed from a one-piece blank, comprising:

a floor;

a pair of opposed first side walls hingedly joined to the floor along respective fold lines;

a pair of opposed second side walls hingedly joined to the floor along respective fold lines;

said first side walls and said second side walls each having opposed side edges located at outside corners of the carton; and at least one corner post extending from a side edge of one of said second side walls adjacent a side edge of one of said first side walls and, said corner post comprising a first post panel extending along said one of said first sidewalls and hingedly joined a second post panel, a third post panel hingedly joined to said second post panel, and a fourth post panel having first and second ends and hingedly joined at a first end to said third post panel and hingedly joined at a second end to said one of said second side walls, said second post panel positioned between said first and said third post panels with said first and said third post panels partly overlying one another and said first, said second, said third post panels forming a Z-shape cross-section.

13. The carton of claim 12 wherein said first and said second post panels and said first and said second sidewalls are of generally equal height.

14. The carton of claim 12 further comprising a pair of lid members hingedly joined to respective ones of the second side walls.

15. A one-piece, integral blank for forming a carton having a floor; a pair of opposed first side walls hingedly joined to the floor along respective fold lines; a pair of opposed second side walls hingedly joined to the floor along respective fold lines; said first side walls and said second side walls each having opposed side edges located at outside corners of the carton; and at least one corner post extending from a side edge of one of said second side walls adjacent a side edge of one of said first side walls and, said corner post comprising a serial succession of four post panels joined end-to-end by fold lines, the post panels folded with a double-reentrant fold to generally form a Z-shape cross-section, the blank comprising:

three rows of carton portions, including a pair of outside rows and an intermediate row; the intermediate row comprising a serial succession of a first lid member, one of the first side walls, the floor, the other first side wall, and a second lid member;

at least one of the outside rows comprising a serial succession of at least four post panels, with one of said first sidewalls extending along a plurality of said post panels.

* * * * *